US006401622B1

(12) United States Patent
Brinkmann

(10) Patent No.: US 6,401,622 B1
(45) Date of Patent: Jun. 11, 2002

(54) SPIN-STABILIZED ARTILLERY PROJECTILE HAVING A METAL SEALING RING

(75) Inventor: Fritz Brinkmann, Werlte (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/451,091

(22) Filed: Nov. 30, 1999

(30) Foreign Application Priority Data

Dec. 2, 1998 (DE) ..... 198 55 536

(51) Int. Cl.[7] ..... F42B 14/00
(52) U.S. Cl. ..... 102/524
(58) Field of Search ..... 102/524, 525–527

(56) References Cited

U.S. PATENT DOCUMENTS

| | | | | | |
|---|---|---|---|---|---|
| 548,884 | A | * | 10/1895 | Maxim | |
| 2,841,688 | A | * | 7/1958 | Andreassen et al. | |
| 2,856,856 | A | * | 10/1958 | Michael | 102/93 |
| 4,552,071 | A | * | 11/1985 | Horais et al. | 102/527 |
| 4,610,205 | A | * | 9/1986 | Bentley | 102/529 |
| 4,797,985 | A | * | 1/1989 | Prochnow et al. | 29/1.21 |
| 4,803,929 | A | * | 2/1989 | Kruse et al. | 102/524 |
| 4,884,508 | A | * | 12/1989 | Kruse et al. | 102/524 |
| 5,081,931 | A | * | 1/1992 | Frye et al. | 102/489 |
| 5,682,011 | A | | 10/1997 | Sabranski et al. | |

FOREIGN PATENT DOCUMENTS

| | | | |
|---|---|---|---|
| DE | 1 152 041 | 7/1963 | |
| DE | 84 33 256.5 | 7/1988 | |
| DE | 40 20 404 A1 * | 1/1992 | ..... F42B/14/06 |
| DE | 40 00 167 | 4/1994 | |
| DE | 114190 | 10/2000 | |
| GB | 25850 | of 1912 | |
| GB | 22286 | of 1915 | |

* cited by examiner

*Primary Examiner*—Charles T. Jordan
*Assistant Examiner*—Kimberly S. Smith
(74) *Attorney, Agent, or Firm*—Venable; Gabor J. Kelemen

(57) ABSTRACT

A spin-stabilized projectile includes a projectile body having a longitudinal axis, a forward and a rearward direction; a metal driving band mounted on the projectile body for transferring spinning forces to the projectile body; a circumferential groove provided in the outer surface of the projectile body rearwardly of the metal guide band; and a metal sealing ring seated in the groove and being freely rotatable relative to the projectile body.

4 Claims, 1 Drawing Sheet

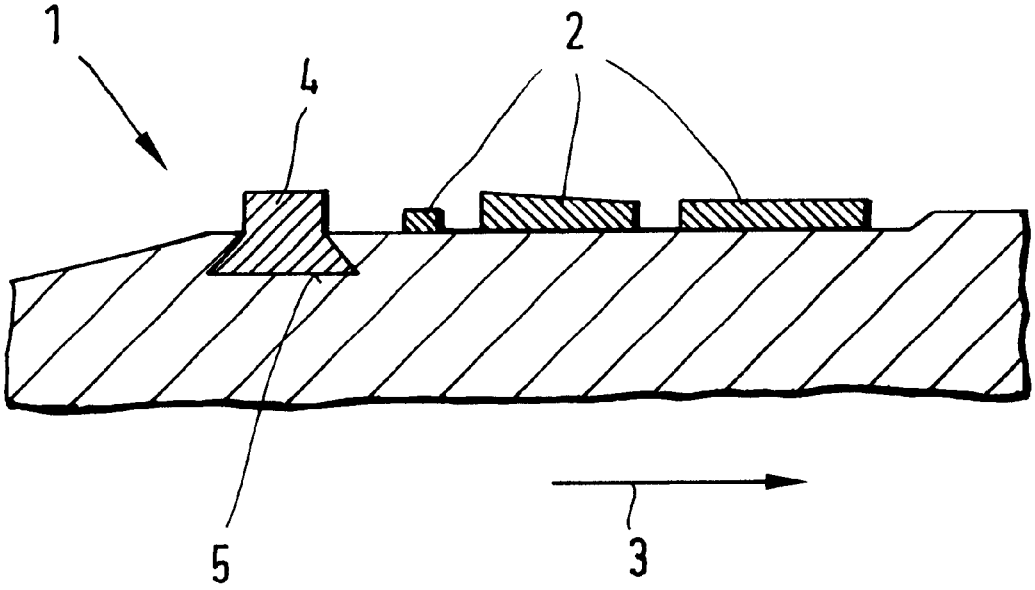
1
2
4
5
3

SPIN-STABILIZED ARTILLERY PROJECTILE HAVING A METAL SEALING RING

CROSS REFERENCE TO RELATED APPLICATION

This application claims the priority of German Application No. 198 55 536.9 filed Dec. 2, 1998, which is incorporated herein by reference.

BACKGROUND OF THE INVENTION

This invention relates to a spin-stabilized artillery projectile having a driving guide band for imparting a spin to the projectile and a sealing ring mounted on the projectile rearwardly of the driving band.

An artillery projectile of the above-outlined type is described, for example, in German Patent No. 40 00 167 to which corresponds U.S. Pat. No. 5,081,931. The known projectile has a driving band provided with a plurality of circumferential grooves and further has a plastic sealing ring (obturator ring) arranged rearwardly of the driving band. The sealing ring serves for improving the seal of the projectile against the high-pressure propelling gases and is, as a rule, secured to the projectile by shrink-fitting.

It has been bound to be a disadvantage of the above-outlined conventional projectiles that the plastic sealing ring may be easily damaged or destroyed by mechanical effects. Damaged or loosely sitting sealing rings are readily stripped from the projectile upon its loading which may lead to safety-relevant problems for the entire weapon system. Further, it has been found that the sealing rings are often lost during transport of the ammunition because their bias diminishes or disappears as the plastic material of the sealing ring ages.

The known projectiles having a plastic sealing ring arranged rearwardly of the guide band are not adapted for use in up-to-date large caliber weapons (such as tank howitzers) operating with an automated ammunition flow.

SUMMARY OF THE INVENTION

It is an object of the invention to provide an improved spin-stabilized artillery projectile of the above-outlined type in which a damaging or destruction or a stripping of the sealing ring upon introduction of the projectile in the loading chamber of the weapon is securely prevented while its sealing function is fully maintained.

This object and others to become apparent as the specification progresses, are accomplished by the invention, according to which, briefly stated, the spin-stabilized projectile includes a projectile body having a longitudinal axis, a forward and a rearward direction; a metal driving band mounted on the projectile body for transferring spinning forces to the projectile body; a circumferential groove provided in the outer surface of the projectile body rearwardly of the metal driving band; and a metal sealing ring seated in the groove and being freely rotatable relative to the projectile body.

Essentially, the invention is based on the principle to provide a metal (preferably copper) sealing ring instead of a plastic sealing ring and the metal sealing ring is seated in a circumferential groove provided in the projectile surface and may freely rotate relative to the projectile.

The metal seal according to the invention does not absorb any energy as the projectile passes through the weapon barrel and since no lateral surface pressure is applied, no wear on the rifling profile occurs, whereby a reliable seal against the propellant gases is ensured.

The seal which is significantly improved as compared to known projectiles to prevent the escape of gas also provides for a significant reduction in the weapon barrel erosion and thus results in a prolongation of the service life of the weapon barrel.

The sealing ring material may be the same as the material used for the driving band; in practice particularly copper/zinc alloys (for example, CuZn10) have been found advantageous.

According to a preferred embodiment of the invention, the groove for the sealing ring has a dovetail cross section; this ensures that even at high projectile rpm's a lift-off of the sealing ring from the groove is securely prevented.

Existing projectiles which are not adapted for use in weapon systems operating with automated ammunition flow because of plastic sealing rings disposed rearwardly of the guide band may be retrofitted in a simple manner. For this purpose it is merely required to machine a groove into the surface of the projectile rearwardly of the driving band and to press the metal sealing ring into the groove.

BRIEF DESCRIPTION OF THE DRAWING

The sole FIGURE is a fragmentary axial sectional view of a projectile incorporating a preferred embodiment of the invention.

DESCRIPTION OF THE PREFERRED EMBODIMENT

The FIGURE shows a fragmentary portion of the rearward part of a projectile 1 carrying a driving band 2 made, for example, of copper. The driving band 2 is composed of three axially spaced driving band parts.

According to the invention, rearwardly of the driving band 2 a copper sealing ring 4 is arranged in a circumferential groove 5 which constitutes a guide having a dovetail-shaped cross section. The sealing ring 4 is so dimensioned diametrically with respect to the diametral dimensions of the groove 5 that the sealing ring 4 is freely rotatable in its seated state with respect to the projectile 1. The dovetail groove 5, in cooperation with an enlargement of the base of the sealing ring 4 prevents a lifting of the sealing ring from the groove even at high projectile rpm's and also provides for a superior seal against the escape of gas.

The invention is not limited to the above-described preferred embodiment. Thus, the driving band 2 and the sealing ring 4 may be made of another suitable metal instead of copper.

It will be understood that the above description of the present invention is susceptible to various modifications, changes and adaptations, and the same are intended to be comprehended within the meaning and range of equivalents of the appended claims.

What is claimed is:

1. A spin-stabilized projectile comprising (a) a projectile body having a longitudinal axis, a forward and a rearward direction;

(b) a metal driving band mounted on said projectile body for transferring spinning forces to said projectile body;

(c) a circumferential groove of dovetail-shaped cross section provided in an outer surface of said projectile body rearwardly of said metal driving band; and (d) a metal sealing ring seated in said groove and being freely rotatable relative to said projectile body; said metal sealing ring having an enlarged base portion seated in said circumferential groove, whereby said metal sealing ring is prevented from lifting off said circumferential groove.

2. The spin-stabilized projectile as defined in claim 1, wherein said driving band and said sealing ring are of the same metal.

3. The spin-stabilized projectile as defined in claim 1, wherein said sealing ring is of a metal selected from the group consisting of copper and a copper alloy.

4. The spin-stabilized projectile as defined in claim 3, wherein said sealing ring is of CuZn10.

* * * * *